US008261581B2

(12) United States Patent
Cerruti et al.

(10) Patent No.: US 8,261,581 B2
(45) Date of Patent: Sep. 11, 2012

(54) DISPENSER OF WASHING AGENTS FOR A HOUSEHOLD WASHING MACHINE, IN PARTICULAR A DISHWASHER

(75) Inventors: Daniele Cerruti, Fontanetto Po (IT); Marco Moro, S. Maurizio di Conzano (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 772 days.

(21) Appl. No.: 12/276,468

(22) Filed: Nov. 24, 2008

(65) Prior Publication Data

US 2009/0133725 A1 May 28, 2009

(30) Foreign Application Priority Data

Nov. 23, 2007 (IT) ..... TO07A000845
Nov. 20, 2008 (EP) ..... 08169520

(51) Int. Cl.
*D06F 29/00* (2006.01)

(52) U.S. Cl. ..... 68/17 R; 134/94; 296/97.22; 220/86.2; 220/DIG. 33

(58) Field of Classification Search ..... 134/93; 68/17 R; 296/97.22; 220/86.2, DIG. 33
See application file for complete search history.

(56) References Cited

U.S. PATENT DOCUMENTS 4,867,337 A * 9/1989 Eichenseer ..... 220/375
5,253,920 A * 10/1993 Eldridge ..... 296/97.22

FOREIGN PATENT DOCUMENTS

| | | | |
|---|---|---|---|
| DE | 3107136 | A1 | 9/1982 |
| DE | 3196136 | C2 | 5/1985 |
| DE | 19757679 | A1 | 7/1989 |
| DE | 19535153 | * | 3/1997 |
| DE | 19535153 | A1 | 3/1997 |
| DE | 19535153 | B4 | 5/2005 |
| DE | 19757679 | B4 | 1/2008 |
| EP | 0 602 572 | B1 | 7/2002 |
| WO | WO 2007/017755 | A1 | 2/2007 |

* cited by examiner

*Primary Examiner* — Saeed T Chaudhry
(74) *Attorney, Agent, or Firm* — Heslin Rothenberg Farley & Mesiti P.C.; Victor A. Cardona, Esq.

(57) ABSTRACT

A device for dispensing washing agents has a body defined in which is a reservoir for a liquid substance that can be dispensed. The reservoir has a charging passage that can be engaged by a plug. Operatively set between the body of the dispenser and the plug is an articulated connection, provided for keeping the plug mechanically connected to the dispenser even following upon removal of the plug from the charging passage. Preferably the articulated connection is of a "hide-away" type and comprises a movable member to which the plug is constrained so as to present a number of degrees of freedom.

20 Claims, 7 Drawing Sheets

DISPENSER OF WASHING AGENTS FOR A HOUSEHOLD WASHING MACHINE, IN PARTICULAR A DISHWASHER

CROSS REFERENCE TO RELATED APPLICATIONS

This application claims priority from Italian Patent Application No. TO2007A000845 filed on Nov. 23, 2007, and European Application No. 08169520.7 filed Nov. 20, 2008, the entire disclosures of which are incorporated herein by reference.

FIELD OF THE INVENTION

The present invention relates to dispensers of washing agents for household washing machines and has been developed with particular reference to dispensers for dishwashers.

BACKGROUND ART

Dispensers of washing agents for dishwashers are normally provided for delivery of at least two different washing agents, one usually in the form powder or of a tablet and the other in the form of a liquid. Also known are in any case dispensers provided for delivery of a liquid substance only.

For what is of specific interest herein, the body of the dispenser defines inside it a reservoir for containing the liquid washing agent, in an amount sufficient to perform a plurality of cycles of operation by the machine. The dispenser is moreover provided with means for dividing the total amount of liquid agent contained in the reservoir into doses in order to deliver them individually at the appropriate moment in the course of a treatment cycle.

Following upon use of the dishwasher, the reservoir must be periodically topped up and for this purpose it has a charging passage, generally shaped as a pipe that opens on the front of the body of the dispenser. The passage is provided for receiving at least partially a removable plug, of a generally cylindrical shape. The plug and the passage are provided with means for mutual coupling that enable the plug to be kept in a blocking position, in which the charging passage is hermetically closed. The plug can be turned manually by the user of the machine in order to bring the aforesaid coupling means into a respective condition of release, in which the plug itself can be removed from the passage. Once the plug has been removed, the charging passage can be used for adding new liquid washing agent in the reservoir.

In order to enable a hermetic closing of the tank, the plug is provided with an annular gasket, designed to co-operate with a corresponding sealing surface defined in the body of the dispenser, for example, within the charging passage. The coupling means, which are usually of the bayonet-coupling type or possibly of the threaded type, enable precise coupling and tightening of the plug with respect to the charging passage in such a way that the aforesaid gasket co-operates in an effective way with respect to the aforesaid sealing surface.

In the dispensers of the type indicated, the user—after removing the plug from the charging passage—must rest the plug itself somewhere, or else hold it in his hand: this fact renders the operations of topping-up of the reservoir with the liquid washing agent less convenient from the practical standpoint.

Also known are dispensers in which the passage for charging the reservoir with the liquid washing agent can be opened and closed by a hatch, instead of by a removable plug, said hatch being hinged to the body of the dispenser so as to be able to turn about a substantially horizontal axis, or in any case an axis substantially parallel to the front of the body of the dispenser. This hatch is equipped, on its internal face, with a seat for a sealing gasket, which is usually annular and is designed to co-operate in a fluid-tight way on a peripheral lip of the charging passage. Usually provided between the body of the dispenser and the end of the hatch opposite to the hinging end are engagement/disengagement means, which can be operated manually by the user.

This second type of solution enables the problems of poor practicality mentioned previously in relation to the dispensers provided with removable plugs to be overcome. In order to gain access to the charging passage, in fact, the user simply has to tip the aforesaid hatch, with the hatch itself that remains in any case physically joined to the body of the dispenser.

If this type of solution on the one hand facilitates to some extent the activity of topping-up of the reservoir with the liquid washing agent, on the other hand it does not prove completely efficient and reliable. The hatch has in fact the points of hinging and engagement in closing that are at a distance from one another (typically at the two opposite ends of the hatch), as well as at a distance from the sealing region provided by the gasket, which is mounted in the intermediate part of the hatch. This configuration, together with the typical reduced thickness (approximately 2 mm) of the body made of plastic material of the hatch, can give rise to non-uniform bending and/or yielding and/or compression of the gasket resting on the corresponding sealing surface. The solutions using hatches are moreover less reliable in the long run, precisely on account of degradation in the quality of the seal provided by the gasket. It is to be considered also that the body of the hatch, which is thin and made of plastic material, is subject over time to innumerable thermal cycles. This can give rise to deformations of the hatch, which, albeit minimal and even only temporary, adversely affect the quality of the seal in an area corresponding to the passage for charging the reservoir.

SUMMARY OF THE INVENTION

The object of the present invention is to provide a dispenser of washing agents for a household washing machine, in particular a dishwasher, which enables a solution to the drawbacks recalled above in relation to the prior art in a simple and economically advantageous way.

The above and other objects still, which will emerge more clearly hereinafter, are achieved according to the present invention by a dispenser having the characteristics specified in the annexed claims. The claims form an integral part of the technical teaching provided herein in relation to the invention.

BRIEF DESCRIPTION OF THE DRAWINGS

The characteristics and advantages of the invention will emerge clearly from the ensuing detailed description, with reference to the annexed drawings, which illustrate a non-limiting example of the invention. In the drawings.

DETAILED DESCRIPTION OF PREFERRED EMBODIMENTS OF THE INVENTION

Figure 1:
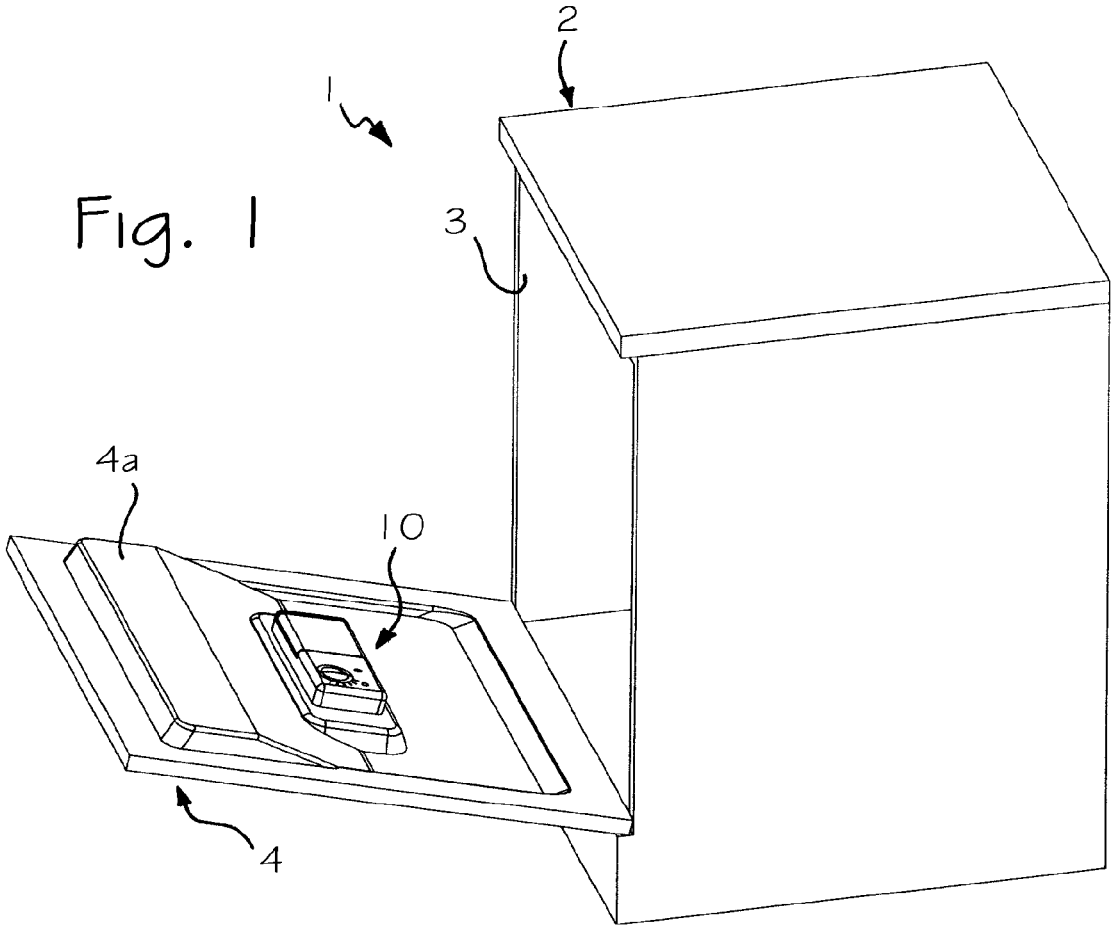
FIG. 1 is a schematic perspective view of a dishwasher provided with a dispenser of washing agents according to the present invention.

In FIG. 1, designated as a whole by 1 is a household washing machine provided with a device for dispensing washing agents according to the present invention. In the example represented, the machine 1 is a dishwasher, comprising a cabinet 2 defined inside which is a treatment tank or chamber 3. The dishwasher 1 comprises a front door 4, hinged in its lower part to the cabinet 2, so as to turn according to a substantially horizontal axis, in such a way that the internal face 4*a* of the door itself provides the front wall of the tank 3. The machine 1 comprises all the elements normally known for its operation, which will not be described herein, as well as—instead of a traditional dispenser of washing agents—a dispenser provided according to the teachings of the present invention, designated as a whole by 10. In the non-limiting example illustrated, the dispenser 10 is mounted in a stationary position on the counter-door 4*a*, at least partially set-in in an opening provided for said purpose. The invention can in any case be applied also to dispensers having a configuration different from the one represented. For greater clarity of representation, in FIGS. 2-14, the dispenser 10 has been represented in isolation.

Figure 2:
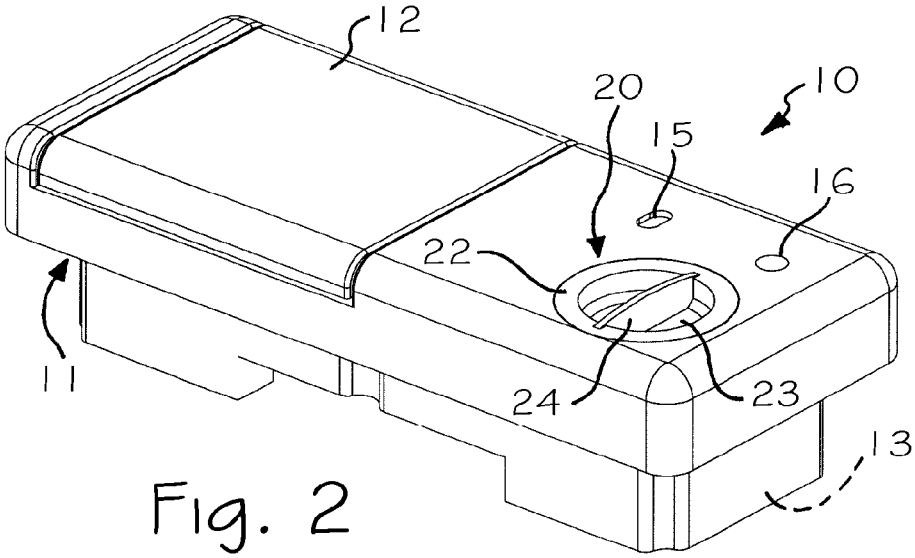
FIGS. 2 and 3 are perspective views of the dispenser of the machine of FIG. 1, in two different conditions.
Figure 3:
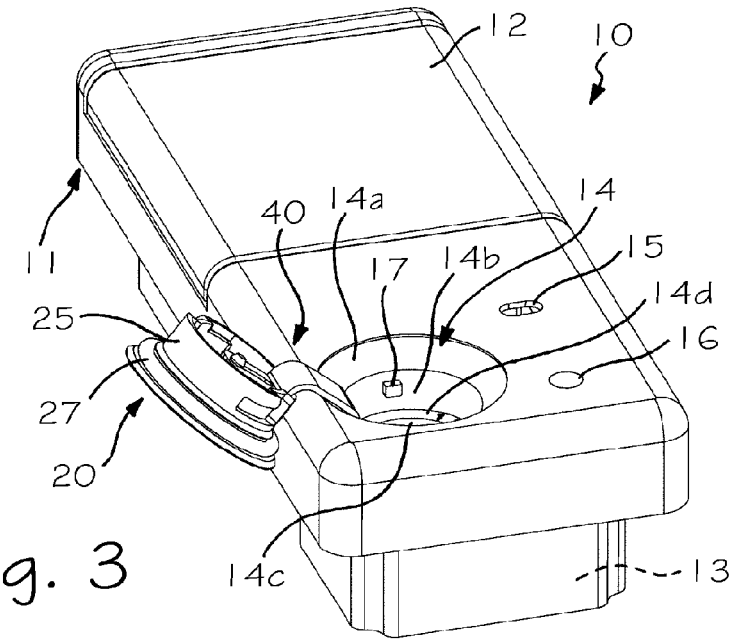

As may be seen in FIGS. 2 and 3, the dispenser 10 comprises a body designated as a whole by 11, for example, formed by two parts or half-shells made of thermoplastic material fixed or welded to one another, with modalities in themselves known. The dispenser 10 also comprises a system of actuation provided for delivering at least two different washing agents, which, in the example considered herein, are a detergent in the solid form (for example, in powder form or in a tablet) and an additive in the fluid form, in particular a liquid washing agent, such as a liquid rinse aid or lustering agent. Purely by way of example, the aforesaid system of actuation can be of the type described in EP-A-0 602 572 or else in WO 2007 017755, filed in the name of the present applicant, the teachings of which are considered as being incorporated herein.

For the above purpose the body 11 defines, in its front part, a cavity designed to contain a dose of the detergent, which is not visible in the figures in so far as it is covered by a usual tippable hatch, designated by 12.

Moreover defined inside the body 11 is a reservoir for containing an amount of rinse aid sufficient for performing a number of treatment cycles by the dishwasher 1. The aforesaid reservoir is designated as a whole by 13 in FIGS. 2-3, as well as in the cross-sectional views represented in FIGS. 8-14. The invention is described herein by way of example with reference to the case in which the reservoir 13 is designed to contain a rinse aid, but the invention is equally applicable also to the case of dispensers having one or more reservoirs provided with plugs and designed to receive a fluid substance different from a rinse aid, such as a liquid detergent, a bleaching agent, a detergent in the form of gel or foam, etc. By the term "washing agents" is moreover meant, in addition to detergent substances and lustering agents, also further substances that can be used in household washing machines, such as softening agents, perfumes, substances for preventing the colours from running, water-softening agents and anti-lime substances, disinfectants, etc., as well as all the other substances or fluid products designed to be dispensed in a washing machine.

The reservoir 13 is in fluid communication with a corresponding charging passage, designated as a whole by 14 in FIG. 3, which can be engaged by a plug, designated as a whole by 20, the passage 14 opening onto the front of the dispenser 10. Once again with reference to FIGS. 2 and 3, the reference number 15 designates an opening for delivery of the lustering agent, and the reference number 16 designates an optical indicator of the level of rinse aid inside the reservoir 13. The optical indicator 16 and, as has been said, the system for delivery of the lustering agent through the opening 15 can be of any known type, and consequently will not be described herein. Here it is sufficient to note that the dosage system includes preferably a member for volumetric adjustment of the doses of lustering agent that can be delivered, which is of a conception and operation in itself known and is designated as a whole by 30 in FIG. 4.

The passage 14 and the plug 20 have means for mutual coupling, which, in a corresponding condition of engagement, are designed to maintain the plug in a position of fluid-tight sealing of the passage. The plug 20 can be manually operated to bring the aforesaid coupling means into a corresponding condition of release, in which the plug itself can be extracted from the passage 14 in order to enable introduction of the lustering agent into the reservoir 13. In addition, as will emerge more clearly in what follows, according to the main aspect of the present invention, operatively set between the plug 20 and the dispenser 10—i.e., its body 11 and/or one of the components associated stably to said body, such as, for example, the member 30—are connection means, designated as a whole by 40 in FIG. 3, which are provided for keeping the plug 20 mechanically connected to the dispenser 10 even following upon removal of the plug 20 from the passage 14.

Figure 5:
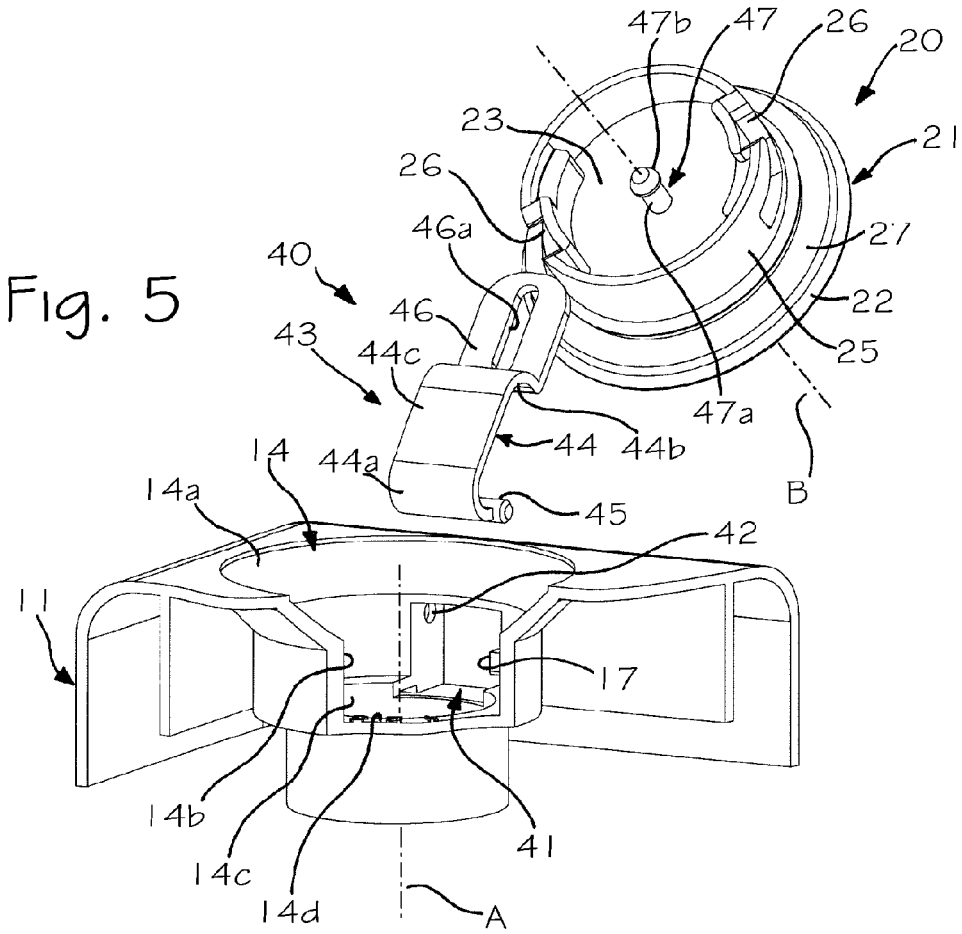
FIG. 5 is an exploded and sectioned view, at an enlarged scale, of a part of the dispenser of FIGS. 2-4.
Figure 4:
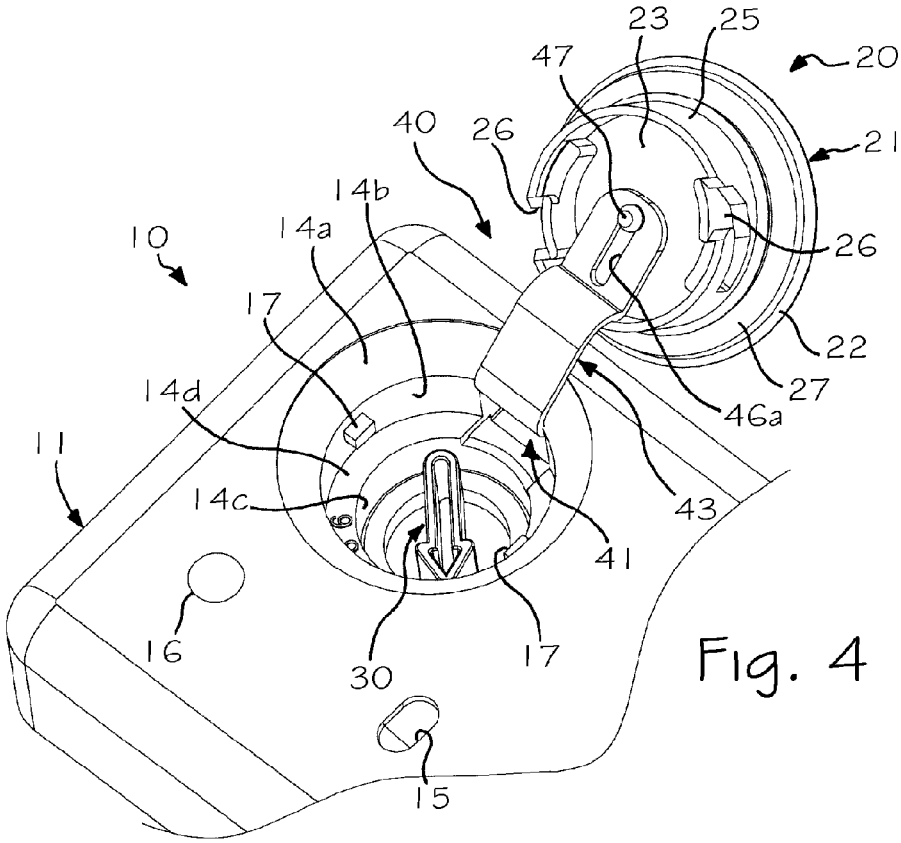
FIG. 4 is a perspective view, at an enlarged scale, of a portion of the dispenser of FIGS. 2 and 3.

In the example of embodiment of FIGS. 4 and 5, the passage 14 is shaped like a conduit axially extended and made up of a number of portions with circular cross section, which is configured for receiving at least partially inside it the plug 20. In the example represented, the passage 14 has, at its upper end, a portion 14*a* generally shaped like a truncated cone or flared towards the inside of the passage, defining a sealing surface, preferably circular and without interruptions. Underneath the portion 14*a* (as viewed in the figures) the passage 14 then has a first portion and a second portion of a generally cylindrical shape, designated by 14*b* and 14*c*, the portion 14*c* having a smaller diameter than the portion 14*b*, and projecting at least partially therein is the volumetric adjustment member 30. Defined between the portions 14*b* and 14*c* is a step having an annular surface or band 14*d*, which is substantially parallel to the front of the body 11. Made on the surface 14*d* are position references for the volumetric adjustment member 30, for example, in the form of numbers. Formed in the cylindrical portion 14*b* are two portions in relief 17, in diametrally opposite positions and projecting substantially radially towards the inside of the passage 14, which form part of a bayonet-coupling system that provides the aforesaid means for mutual coupling between the passage 14 and the plug 20.

Once again with reference to FIGS. 4 and 5, the plug has a body 21, preferably made of a single piece by moulding of thermoplastic material. The top part of the plug has a generally flange-shaped portion, designated by 22 (see also FIG. 2), concentric with respect to a blind cavity, which is closed at the bottom by a wall 23, said cavity being traversed in a diametral direction by a wall 24, which provides a means of gripping and/or actuation of the plug. The lower part of the body 21 of the plug 20 is hollow and is defined peripherally by a cylindrical wall 25, formed in which, in diametrally opposite positions, are two seats or guides 26 for engagement of the portions in relief 17. The specific conformation of these guides 26, belonging to the aforesaid bayonet-coupling system, is not described herein, in so far they can be of any known type. In any case, the guides 26 preferably comprise at least one respective inclined surface. Further provided between the cylindrical wall 25 and the flange portion 22 is a cylindrical region, which defines a positioning seat for a sealing gasket 27 (see also the cross sections represented in FIGS. 8-14). The gasket 27 is here represented as being of the O-ring type, i.e., of the circular type, preferably made of elastomeric material.

In the example of embodiment illustrated, the connection means 40 are operatively set between the body 11 of the dispenser and the plug 20. In the embodiment currently deemed preferential, the connection means 40 are substantially of an articulated type, particularly of the hinge type, with a fixed hinge part and a movable hinge part. In the example illustrated, the fixed hinge part is integral with the body 11 of the dispenser 10 and comprises a cavity, designated as a whole by 41 in FIG. 5, which is formed peripherally with respect to the passage 14 so as to face inside the latter and is provided with at least one seat for a respective hingepin. In the example, the cavity 41 is delimited at the sides by two opposite walls 41*a* of the body 11, formed in each of which is a seat for receiving a hingepin. Visible in FIG. 5 is just one of these seats, designated by 42, but it is to be taken into account that the seat 42 that is not visible is set facing the first, the two seats 42 being set according to one and the same axis. As may be clearly seen in FIGS. 4 and 5, the cavity 41 is formed—substantially in a radial direction with respect to the passage 14—underneath the seal portion 14*a*, and is here prevalently made in the cylindrical portion 14*b* of the passage 14. In this way, the sealing surface defined by the portion 14*a* is integral, i.e., does not present any discontinuity, and thus able to operate in a fluid-tight way or to couple with the entire circular profile of the gasket 27.

The aforesaid movable hinge part comprises a movable member designated as a whole by 43 in FIGS. 4 and 5. The movable member 43 has a substantially C-shaped portion 44, i.e., one distinguished by two curved end regions 44*a* and 44*b*, preferably with an intermediate rectilinear stretch 44*c* between them (the stretch 44*c* could consequently be omitted). A first end (44*a*) of the portion 44 identifies a region of rotatable fixing of the member 43 to the body 11 of the dispenser 10, and defined in said region is at least one hingepin. In the example, a single pin is provided, designated by 45 in FIG. 5, which is formed integrally in the member 43 and the two cylindrical ends of which are designed to be fitted in the seats 42 of the cavity 41 so as to couple rotatably the movable hinge part to the fixed hinge part, the axis of rotation being substantially perpendicular to the axis of the passage 14, designated by A. The pin 45 can possibly be replaced by an added or separate component, or else by two distinct coaxial pins, projecting from opposed areas of the end region of the portion 44 of the member 43, or else again be replaced by any other element designed to enable at least an angular or rotating movement for the member 43. The member 43 has then a generally flattened and longitudinally extended portion 46, joined to the second end region 44*b* of the portion 44, said portion 46 identifying a region of fixing of the movable member 43 to the plug 20.

According to a preferential characteristic of the invention, the plug 20 is secured in a movable way to the movable member 43, in order to enable the plug itself to be at least rotated according to its own axis, designated by B. For this purpose, in the example represented, the movable member 43 has an engagement seat designed to withhold in a movable way an element for fixing the plug. In the example of FIGS. 4 and 5, the aforesaid engagement seat is shaped substantially as a slot extending longitudinally, designated by 46*a*, provided in the flattened portion 46 of the movable member 43. The aforesaid fixing element is instead substantially configured as an axial pin of the plug 20, designated by 47. As may be noted particularly in FIG. 5, the aforesaid pin 47 extends starting from the wall 23 of the body 21 of the plug, substantially in a central position with respect to said wall 23 and substantially coaxial to the cylindrical wall 25. The pin 47 is substantially mushroom-shaped; i.e., it has a cylindrical stem 47*a* and a head 47*b* widened with respect to the stem, preferably of a flared or pointed shape, i.e., a shape designed to facilitate the operations of assembly, also as a result of the partial elasticity of the components, which are preferably made of thermoplastic material. The pin 47 is fitted into the slot 46*a* of the member 43, with the head 47*b* that guarantees maintenance of the condition of engagement between the parts. It will be appreciated that the type of coupling is such that the plug 20 is able to turn about its own axis B, and that this axis B can translate with respect to the member 43, given that the pin 47 is able to slide within the slot 46*a*. Preferably, the axis of rotation of the member 43, provided by the coupling between the pin 45 and the seats 42, is substantially orthogonal to the lengthwise direction of the slot 46*a*, and is also orthogonal to the axis A of the passage 14, it being possible however also to envisage more or less marked inclinations or angles between said axes and/or directions. Of course, the mode of coupling could be reversed with respect to the case illustrated, albeit obtaining the same functions. In said perspective, for example, the member 43 can be provided with a pin similar to the pin 47 of the plug 20, whilst the plug 20 can be provided with a slot-shaped seat similar to the slot 46*a* of the connection element 43, which can be coupled to one another.

Figure 6:
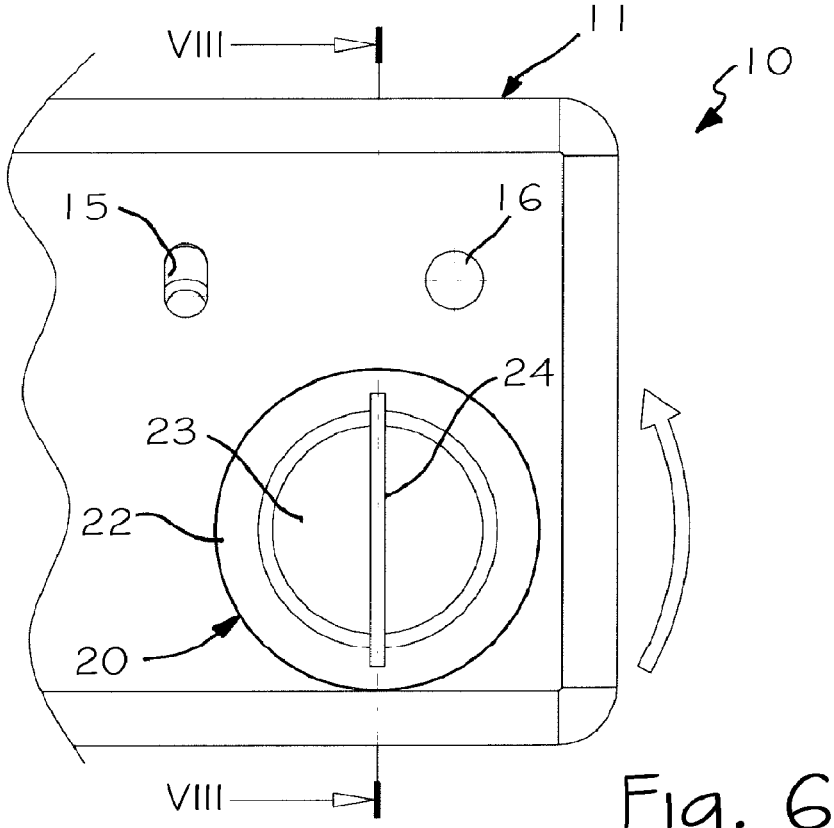
FIGS. 6 and 7 are two views in front elevation of a portion of the dispenser of the previous figures, in two different conditions.

Operation of the dispenser according to the invention, as regards the characteristics of specific interest, is very simple and practical and will be described with reference to FIGS. 6-14. FIG. 6 illustrates the typical condition of closing of the plug 20. The plug 20 is set within the passage 14, in a position such that the bayonet-coupling system represented by the portions in relief 17 and by the guides 26 (see FIGS. 4 and 5) is in the blocking condition. In said condition, as may be seen in FIG. 8, the plug 20 closes the passage 14 in a fluid-tight way. The gasket 27 rests and is compressed on the flared sealing surface 14*a* of the passage 14, and the member 43 is in a first end position.

Figure 7:
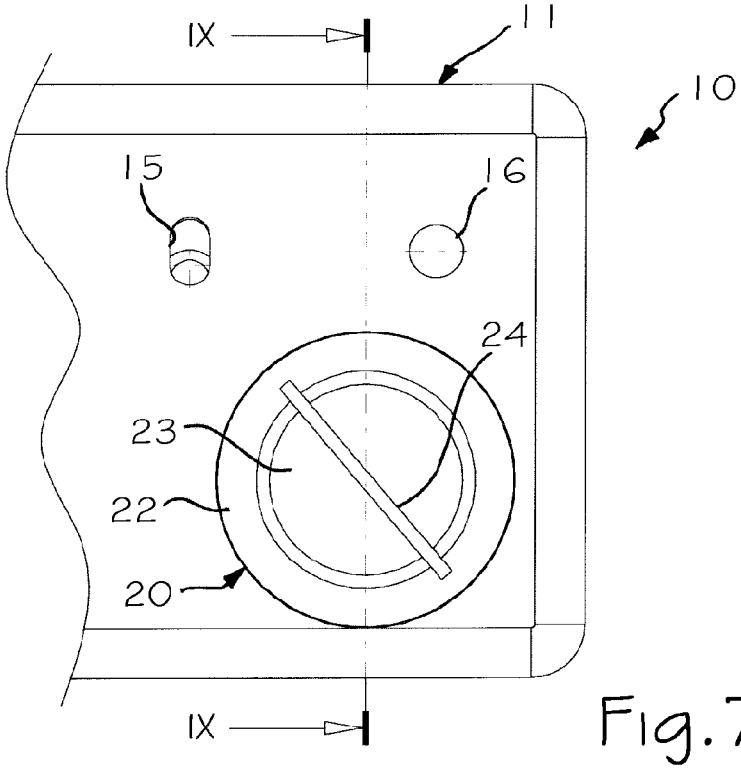
Figure 9:
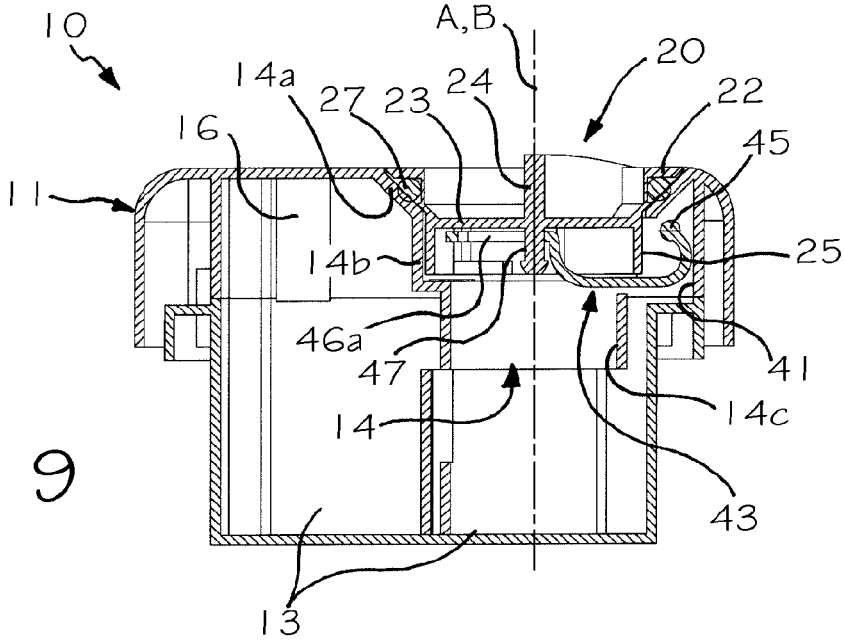

In order to pass into the condition of release of the plug 20 with respect to the passage 14, the user simply has to act manually on the plug itself, for example holding it between two fingers in an area corresponding to a diametral wall 24 thereof (FIG. 2) and imparting on the plug a rotation about its own axis. Said angular movement determines release of the bayonet-coupling system. This situation is illustrated in FIGS. 7 and 9. It will be appreciated that the plug 20 has a first degree of freedom of movement with respect to the movable member 43, the plug being able in fact to turn about its own axis with respect to said member, albeit within the passage 14.

FIGS. 10-14 illustrate successive conditions of the movement of removal of the plug 20 from the passage 14. For greater clarity, in FIGS. 6, 8 and 10-14 certain components of the dispenser are not represented, such as the adjustment member 30. From these figures, it is possible to note how the cavity 41 extends at least in part underneath the sealing surface 14*a*, with reference to the direction of introduction of the plug 20 into the passage 14, as well as how the axis of rotation provided by the pin 45 of the movable hinge part 43 is located on the outside of the passage 14.

Figure 10:
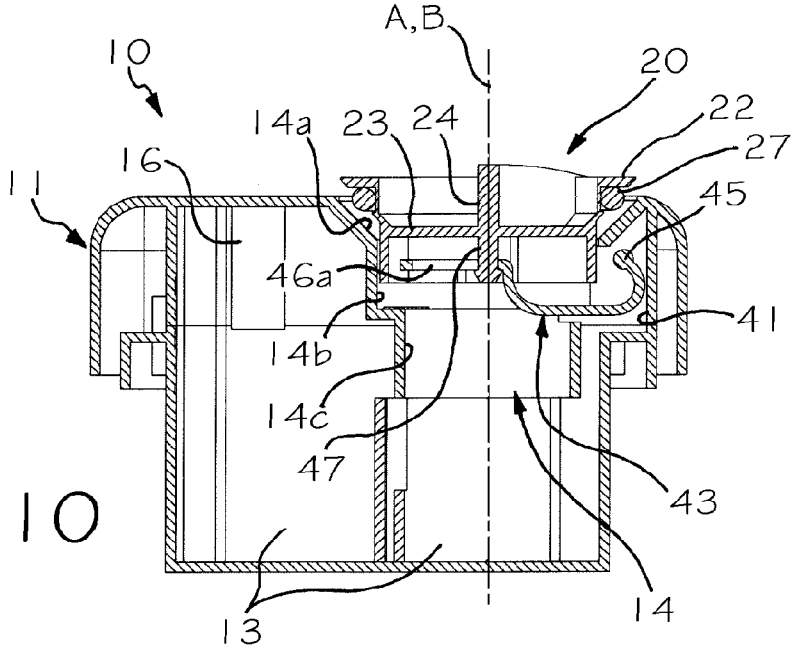
Figure 11:
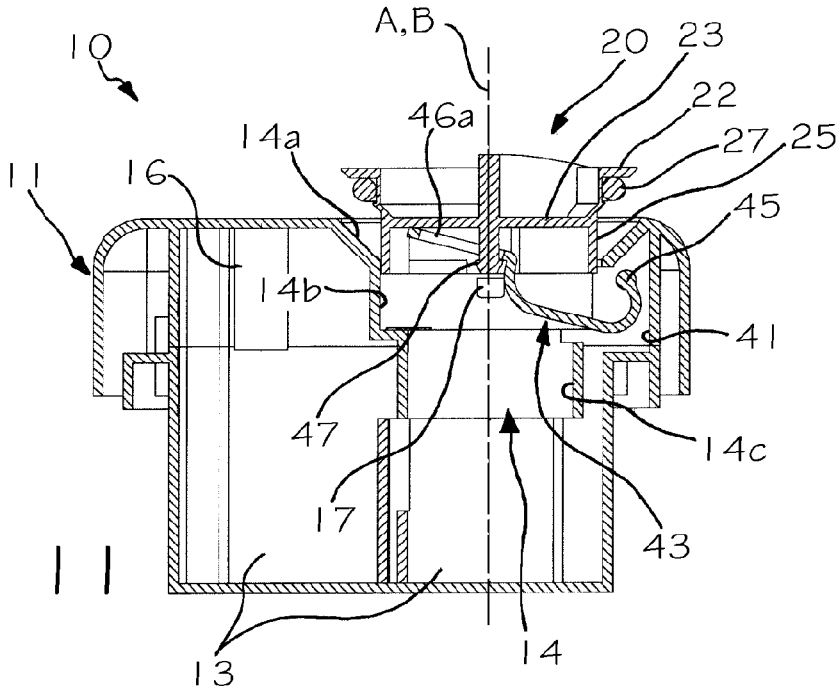

FIG. 10 highlights how the plug 20 is allowed a second degree of freedom with respect to the member 43, in an axial direction with respect to the pin 47. From said figure, it may in fact be appreciated how the plug 20 can be raised axially or vertically within the passage 14, without necessarily causing any movement or interference with the member 43. This second degree of freedom is evidently allowed by the axial extension of the pin 47.

Proceeding with extraction of the plug 20, the head of the pin 47 (reference 47*b*, FIG. 5) comes into contact with the surface of the flattened part 46 of the movable member 43, and the latter is induced as a whole to rise or else to rotate according to the axis defined by the hingepin 45. In this step, the plug 20 is still partially inserted in the cylindrical portion 14*b* of the passage 14, but the plug itself is allowed a third degree of freedom with respect to the movable member 43. From FIG. 11 it may be appreciated, in fact, how the portion 46 of the member 43 can be inclined with respect to the pin 47. Also this third degree of freedom is allowed by the axial extension of the pin 47.

Figure 12:
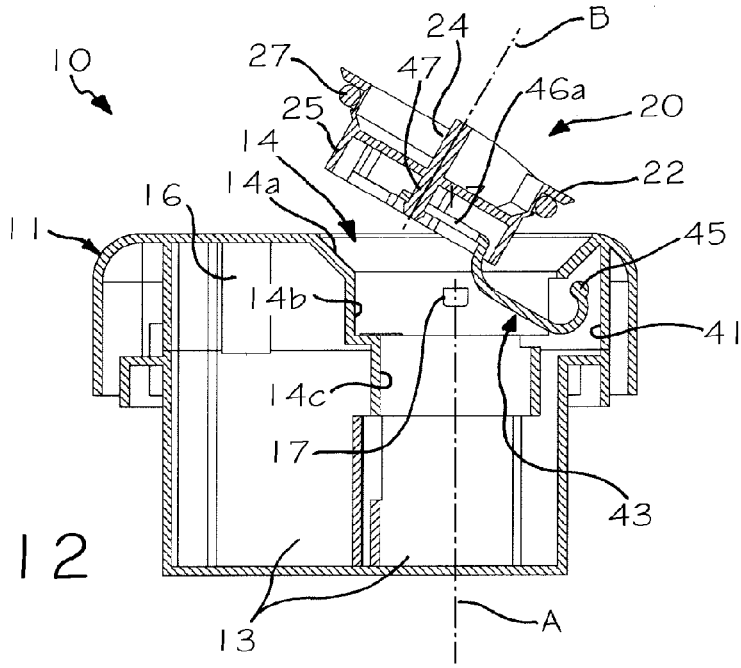
Figure 13:
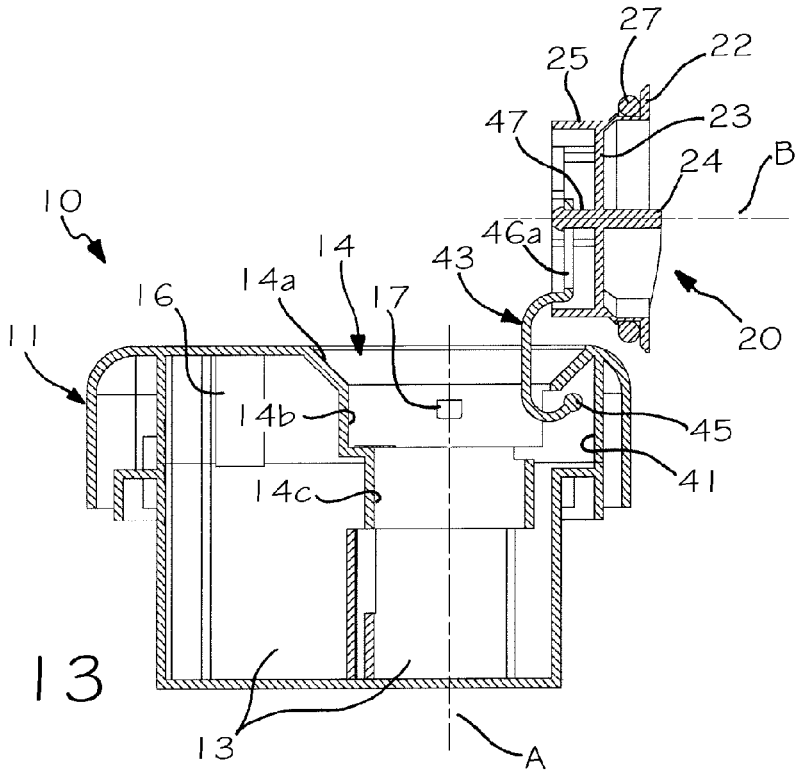

FIG. 12 illustrates a subsequent moment, in which the plug 20 is practically disengaged from the passage 14. Reaching of the position illustrated is allowed thanks to the further angular movement of the movable member 43 about the hingepin 45. In this step, the plug 20 has a fourth degree of freedom with respect to the member 43, given that the pin 47 is able to slide within the slot 46*a*, substantially from its first end (FIG. 11) as far as the opposite end (FIG. 12), or in intermediate positions, and hence with the plug 20 that can be displaced substantially parallel to the member 43, or at least to a portion 46 thereof. This fourth degree of freedom also enables displacement of the plug 20 so as to overcome possible further obstacles, which are also constituted by the portions or profiles themselves of the body 11 of the dispenser 10.

Figure 14:
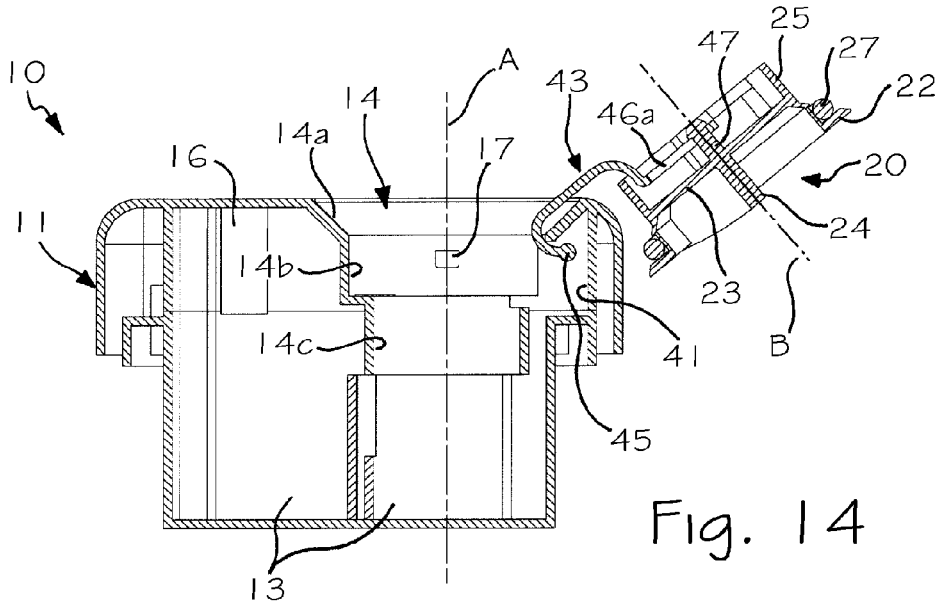
FIGS. 10-14 are cross-sectional views, similar to those of FIGS. 8 and 9, of the dispenser, in as many instants of the movement of opening of a corresponding plug.

Once again by holding the plug 20 between the fingers of one hand, the user can then complete the movement of the plug about the axis provided by the hingepin 45. At a certain point of the movement, the plug will occupy the position illustrated in FIG. 13 and then the one illustrated in FIG. 14, which substantially corresponds to the condition represented in FIG. 4. It should be noted that the position of FIG. 4 or FIG. 14 is maintained even when the user is no longer holding the plug 20 in his hand, thanks to the weight of the plug itself and to the articulated-connection means 40.

Of course, in practice, in certain of the opening steps, the plug 20 could assume positions different from those described and illustrated purely by way of example in FIGS. 10-14.

In all of the conditions illustrated, the plug 20 is in any case constrained to the dispenser 10 (to its body 11, in the example of embodiment), via the connection means 40. From FIGS. 4 and 14 it will be moreover appreciated that, in the end-of-travel position of the articulated-connection means 40 or else in the position of maximum opening of the plug 20, the latter comes to occupy, and is kept in, a respective position of non-encumbrance, i.e., outside the region of the passage 14, and preferably at least in part on the outside of the front perimetral profile of the body 11 so as to not constitute a hindrance to the operations of topping-up with the rinse aid. The aforesaid end-of-travel position or position of maximum opening can advantageously be determined by the interference between the member 43—and in particular its curved part 44*a*—with the body 11 of the dispenser within the passage 14, a little underneath the sealing surface defined by the portion 14*a* (see in particular FIG. 14). Alternatively, the aforesaid position could be determined by the fact that the plug rests on or interferes with parts of the dispenser and/or of the washing machine.

As may be readily appreciated, in the end-of-travel position or position of maximum opening, the charging passage 14 is preferably completely free from the plug 20, and the user can pour in the rinse aid, for example up to filling the reservoir 13, which can be detected through the level indicator 16. Once this operation has been completed, the user simply has to move the plug 20 in an opposite way to the one illustrated in the sequence of FIGS. 6-14, bringing the plug within the passage 14, thus obtaining insertion of the portions in relief 17 in the inlet of the guides 26 and then imparting on the plug an angular movement about its own axis in order to produce a new coupling of the bayonet-coupling system.

Figure 8:
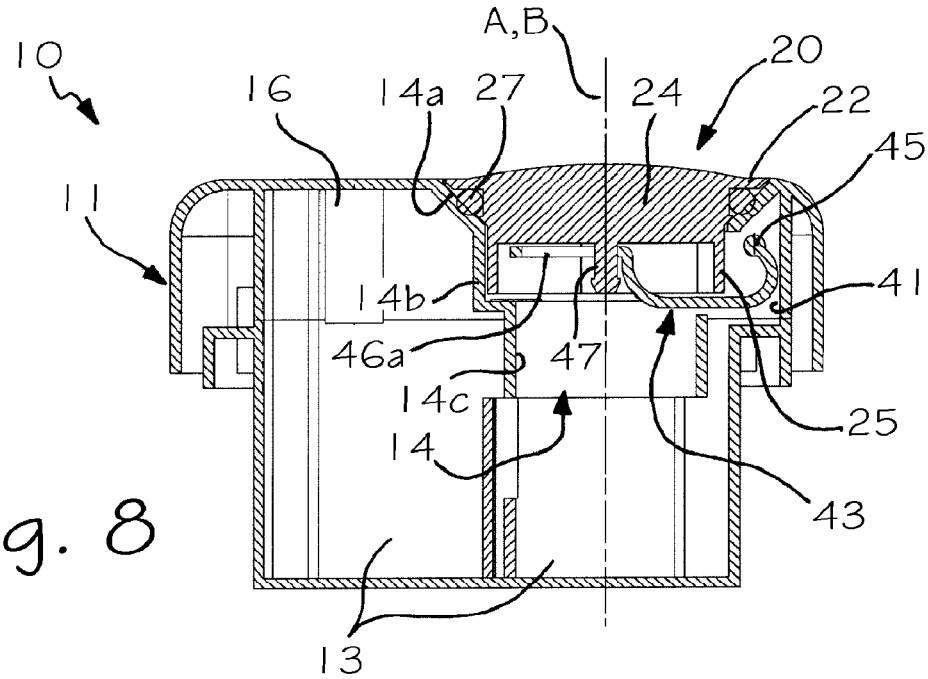
FIGS. 8 and 9 are cross sections according to the lines VIII-VIII and IX-IX of FIGS. 6 and 7, respectively.

It is to be highlighted that, according to a further preferential characteristic of the invention, the means 40 that constrain the plug 20 mechanically to the body 11 of the dispenser 10 are of a "hide-away" type, i.e., configured so that they are hidden from view and/or in a protected position when the plug 20 is in the respective condition of closing of the passage 14, as may be appreciated from an examination of FIGS. 3, 6 and 8. As may be noted, in particular from FIG. 8, the means 40 are in part hidden via the plug 20 and in part received in the cavity 41. In addition to enabling a pleasant aesthetic effect of the dispenser 10, this characteristic prevents the presence of elements of encumbrance towards the inside of the tank 3 of the machine, moreover preventing the constraint means 40 from possibly being accidentally damaged.

It should also be emphasized that, thanks to the provision of the cavity 41 within an intermediate portion of the passage 14, the sealing surface defined by the portion 14*a* is without any discontinuity. In this way, the gasket 27 can perform an effective seal in an area corresponding to the charging passage 14. Of course, the seal that can be secured via a plug with gasket is of a quality, reliability, and constancy that are decidedly greater as compared to the known solutions mentioned in the introductory part of the present description, in which a gasket is carried by a hatch hinged to the body of the dispenser. The plug with gasket has a sturdy structure, is not subject to bending or yielding, and has points of fixing or coupling located in the immediate vicinity of the seal element.

The solution proposed is extremely inexpensive from the standpoint of production, given that:

- the body 21 of the plug 20 (i.e., the entire plug except for the gasket 27) can be made of a single piece of plastic material, particularly via moulding of thermoplastic material;
- the cavity 41 can be completely obtained in the body 11 made of plastic material of the dispenser 10, also in this case in particular via moulding of thermoplastic material; and
- the movable member 43 can likewise be obtained in a simple way, via an operation of moulding of plastic or thermoplastic material.

From the above description, the characteristics and advantages of the present invention emerge clearly. It is clear that numerous variants of the dispenser of washing agents described herein by way of example are possible for the person skilled in the sector, without this implying any departure from the scope of the present invention as defined in the annexed claims. It is to be understood that falling within the scope of the invention are also washing machines, in particular dishwashers, provided with a dispenser like the one forming the subject of the invention.

Of course, the connection means can be shaped also in a way different from the one described and illustrated by way of example. It is pointed out in particular that the rotatable coupling between the member 43 within the cavity 41 can be at least in part opposite to the one described, i.e., with the member 43 that defines at least one seat for receiving a respective hingepin, the latter being defined inside the cavity 41.

The movable hinge part can comprise, instead of a single component 43, a number of distinct items, which are also articulated with one another and/or with respect to the plug 20 and/or to the dispenser 10. In addition, the connection means, instead of comprising one or more substantially rigid members, could advantageously comprise at least one element made of elastic or flexible material—for example, a plastic material or an elastomer—, which is also configured as element or part with reduced thickness (for example, defining integrally a hinge of the type defined as "living hinge").

As has been said, the body 21 of the plug 20 is preferably made of a single piece of thermoplastic material so as to integrate also the pin 47. It is, however, clear that, alternatively, the pin 47 can be configured as an additional part. Also the coupling means between the plug and the movable member that represents the movable hinge part can be different from the ones illustrated by way of example, but preferably once again configured with a view to enabling displacement of the plug between two angular positions in order to produce coupling and release of the means that withhold the plug itself in the position of fluid-tight sealing.

In a further possible variant, the means for mutual coupling between the plug and the charging passage are of a threaded type, instead of being of the bayonet-coupling type, or yet again ones of a press-block-coupling or snap-action-coupling type. The charging passage, instead of being configured as pipe that extends towards the inside of the body of the dispenser, can also be of a type different from the one illustrated, and for example comprise a tubular part projecting towards the outside, on which the plug can be engaged with a bayonet system, threaded or of the press-block-coupling type.

In the embodiment previously exemplified, the plug 20 has been described with reference to a constraint or connection with respect to the body 11 of the dispenser 10, but any connection of the plug 20 to other parts or components belonging or associated to the dispenser are to be considered as forming part of the invention. For example, the plug 20 can be connected or constrained to the adjustment member 30, the mechanical connection or constraint being preferably such as to enable movements of the plug 20 with respect to the member 30.

The invention claimed is:

1. A dispenser of washing agents for a household washing machine, the dispenser comprising a dispenser body defined in which is a reservoir for a fluid substance that can be dispensed, the reservoir having a charging passage that can be engaged or that can be closed by a plug, between the plug and the charging passage there being operative sealing means, wherein the charging passage and the plug have means for mutual coupling configured for maintaining, in a respective blocking condition, the plug in a position of fluid-tight sealing of the charging passage, the plug being manually operable for bringing the coupling means into a respective condition of release, in which the plug can be removed from the charging passage in order to enable introduction of the fluid substance into the reservoir, wherein operatively set between the dispenser body and the plug are connection means, provided for keeping the plug mechanically connected or constrained to the dispenser also following upon removal of the plug from the charging passage, wherein the plug has an upper portion and a lower portion, a sealing gasket being provided at said upper portion of the plug;

wherein the charging passage has, at an upper region thereof, a sealing surface on which the sealing gasket of the plug rests when the means for mutual coupling are in the respective blocking condition, wherein the connection means comprise a hinge having a fixed hinge part and a movable hinge part, and a first engagement means on the plug and a second engagement means on the movable hinge part;

wherein the fixed hinge part comprises a cavity which is defined under said sealing surface and is provided with at least one seat for hinge-pin means;

wherein the movable hinge part comprises a movable member including a first portion and a second portion, said first portion having a first end region and a second end region opposite to each other, said hinge-pin means being provided at said first end region, said first end region being at least partially housed within said cavity when the means for mutual coupling are in the respective blocking condition.

2. The dispenser according to claim 1, wherein said first end region is at least partially housed within said cavity also when the means for mutual coupling are in the respective condition of release with the plug removed from the charging passage.

3. The dispenser according to claim 1, wherein said first end region is included in a first curved part of the first portion of the movable member.

4. The dispenser according to claim 3, wherein said second portion of the movable member axially extends from said second end region of the first portion, said second end region being included in a second curved part of the movable member.

5. The dispenser according to claim 1, wherein said cavity is defined in a radial position relative to the charging passage and faces at least partially into the charging passage.

6. The dispenser according to claim 1, wherein the first engagement means and the second engagement means comprise an engagement seat and an engagement pin which is coupled in a slidable and rotatable manner in the engagement seat.

7. The dispenser according to claim 6, wherein said engagement seat is defined at said second portion of the movable member and said engagement pin is at the lower portion of the plug.

8. The dispenser according to claim 7, wherein said lower portion of the plug is hollow and is defined by a bottom wall and a cylindrical wall, the engagement pin extending from said bottom wall, substantially in a central position thereof and substantially coaxial to said cylindrical wall.

9. The dispenser according to claim 6, wherein said engagement pin is substantially mushroom-shaped.

10. The dispenser according to claim 6, wherein said engagement seat is shaped substantially as a slot extending longitudinally in an axial direction of said second portion of the movable member.

11. The dispenser according to claim 1, wherein said hinge-pin means comprise two hinge-pins projecting from opposite sides of said first end region of the first portion of the movable member and said cavity of the fixed hinge part has two opposite walls, formed in each of which is a seat for receiving a respective one said hinge-pin.

12. The dispenser according to claim 1, wherein said sealing surface is substantially truncated cone shaped.

13. The dispenser according to claim 1, wherein said hinge-pin means identify an axis of rotation of said movable member which is below at least one of said sealing surface, said sealing gasket of the plug when the plug is in said position of fluid-tight sealing of the charging passage.

14. The dispenser according to claim 1, wherein the dispenser body, the plug, and the connection means are configured in such a way that, at least when the plug is in the respective position of fluid-tight sealing of the charging passage, the connection means are completely hidden from view.

15. The dispenser according to claim 1, wherein the coupling means are configured in such a way that the displacement between said conditions of blocking and release can be obtained by imparting manually on the plug a rotation about a respective axis (B), when the plug engages or obstructs the charging passage.

16. The dispenser according to claim 1, wherein the plug is constrained to the movable member in such a way that:

the plug is able to rotate about an axis (B) thereof;

the plug can translate axially with respect to the movable member;

the plug can be inclined with respect to the movable member;

the plug can translate substantially parallel with respect to at least one portion of the movable member.

17. The dispenser according to claim 1, wherein the connection means are configured in such a way that, in a condition of maximum opening of the plug, the plug occupies a position of non-encumbrance with respect to the charging passage.

18. The dispenser according to claim 17, wherein the connection means are configured in such a way that the weight of the plug keeps the latter in the respective opening condition.

19. A household washing machine, comprising a device for dispensing washing agents according to claim 1.

20. A dispenser of washing agents for a household washing machine, the dispenser comprising a dispenser body defined in which is a reservoir for a fluid substance that can be dispensed, the reservoir having a charging passage that can be engaged or that can be closed by a plug, between the plug and the charging passage there being operative sealing means, wherein the charging passage and the plug have means for mutual coupling configured for maintaining, in a respective blocking condition, the plug in a position of fluid-tight sealing of the charging passage, the plug being manually operable for bringing the coupling means into a respective condition of release, in which the plug can be removed from the charging passage in order to enable introduction of the fluid substance into the reservoir, wherein operatively set between the dispenser body and the plug are connection means, provided for keeping the plug mechanically connected or constrained to the dispenser also following upon removal of the plug from the charging passage, wherein the plug has an upper portion and a lower portion, a sealing gasket being provided at said upper portion of the plug;

wherein the charging passage has, at an upper region thereof, a sealing surface on which the sealing gasket of the plug rests when the means for mutual coupling are in the respective blocking condition, wherein the dispenser body, the plug and the connection means are configured in such a way that, at least when the plug is in the respective position of fluid-tight sealing of the charging passage, the connection means are completely hidden from view, wherein the connection means comprise a hinge having a fixed hinge part, a movable hinge part and hinge-pin means;

a first engagement means on the plug and a second engagement means on the movable hinge part, and wherein said hinge-pin means identify an axis of rotation of said movable hinge part which is below at least one of said sealing surface, said sealing gasket of the plug when the plug is in said position of fluid-tight sealing of the charging passage.

* * * * *